US005690442A

United States Patent [19]

Sato et al.

[11] Patent Number: 5,690,442

[45] Date of Patent: Nov. 25, 1997

[54] METAL TIP FOR BALL-POINT PEN

[75] Inventors: Shinsuke Sato, Yonezawa; Toshiaki Takayanagi, Yokohama; Toru Kitao, Sagamihara; Masao Hashi, Yokohama, all of Japan

[73] Assignee: Mitsubishi Pencil Kabushiki Kaisha, Tokyo, Japan

[21] Appl. No.: 573,002

[22] Filed: Dec. 15, 1995

[30] Foreign Application Priority Data

Feb. 7, 1995 [JP] Japan ..... 7-019235

[51] Int. Cl.[6] ..... B43K 7/10

[52] U.S. Cl. ..... 401/216

[58] Field of Search ..... 401/216, 212, 401/211, 210, 209, 219; 29/441.1, 441.2

[56] References Cited

U.S. PATENT DOCUMENTS

| | | | |
|---|---|---|---|
| 3,281,933 | 11/1966 | Fehling et al. | 401/209 X |
| 3,302,279 | 2/1967 | Rosa | 29/441.1 |
| 3,463,106 | 8/1969 | Azzariti | 401/209 |
| 3,502,418 | 3/1970 | Payne | 401/216 |
| 3,781,123 | 12/1973 | Linz et al. | 401/216 |
| 5,104,249 | 4/1992 | Elsner et al. | 401/216 |

FOREIGN PATENT DOCUMENTS

| | | | |
|---|---|---|---|
| 492579 | 5/1953 | Canada | 401/216 |
| 971021 | 6/1950 | France | 401/209 |
| 1.340.445 | 1/1964 | France . | |
| 1428390 | 1/1966 | France | 401/216 |
| Hei 6-191190 | 12/1992 | Japan . | |
| Hei 6-38709 | 10/1994 | Japan . | |
| 420910 | 3/1967 | Switzerland | 401/216 |
| 653385 | 5/1951 | United Kingdom | 401/209 |
| 715042 | 9/1954 | United Kingdom | 401/209 |
| WO 94/00304 | 11/1994 | WIPO . | |

*Primary Examiner*—Mickey Yu
*Assistant Examiner*—D. Neal Muir
*Attorney, Agent, or Firm*—Darby & Darby

[57] ABSTRACT

This invention provides a metal tip for a ball-point pen, having an ink guide hole (2) formed at the center of the bottom surface of a ball holding portion (1) and radial grooves (3) arranged around the ink guide hole. The ink guide hole has a diameter 30 to 55% the diameter of a ball and a length 1.2 to 2 times the diameter of the ink guide hole. A cleaning tool, used for removing a flash which is formed during formation of the radial grooves (3) by cutting (broaching) and which projects into the ink guide hole (2), is set to have a diameter 70 to 97% the diameter of the ink guide hole, so that only a base portion of the projecting flash is left.

4 Claims, 2 Drawing Sheets

METAL TIP FOR BALL-POINT PEN

BACKGROUND OF THE INVENTION (1) Field of the Invention

The present invention relates to a metal tip for a ball-point pen having an ink guide hole formed at the center of the bottom surface of an ink holding portion and radial grooves arranged around the ink guide hole.

(2) Description of the Prior Art

As a conventional metal tip 10 for a ball-point pen, as shown in FIGS. 1 and 2, one having an ink guide hole 2 for guiding an ink near the ball 11 and radial grooves 3 for guiding the ink to an ink reservoir 5 that stores the ink actually used for writing is generally known. When the radial grooves 3 are formed by cutting, a flash is formed to project into the ink guide hole 2. The step of cutting this flash is provided after the step of forming the radial grooves 3. The flash is removed by cutting or shearing with a drill or a pin having Substantially the same diameter as that of the ink guide hole 2.

Japanese Utility Model Publication Hei 6 No.38709 discloses a ball-point pen having a metal tip 10 which is formed with a spherical ball seat portion in the bottom wall 4 of a ball holding portion 1 by pressure deformation. The diameter of the ball seat portion is 80 to 90% diameter of the ball 11. The diameter A of the ink guide hole 2 is 45 to 50% diameter of the ball 11. The length in the axial direction of a plastically deformed portion, which is formed in the opening portion of the upper end of the ink guide hole 2 by pressure deformation during formation of the ball seat portion, is 10 to 20% diameter of the ink guide hole 2.

The characteristic feature of this ball-point pen resides in that the length in the axial direction of the plastically deformed portion formed in the opening portion of the upper end of the ink guide hole 2 is set to 10 to 20% diameter of the ink guide hole 2.

Japanese Patent Application Laid-open Hei 6 No.191190 discloses a ball-point pen in which radial grooves 3 are formed to extend to a back hole 6, which is formed behind the ink guide hole 2. Cut segments that are formed by cutting during machining the radial grooves 3 are left between the radial grooves 3 and the back hole 6, thus forming inwardly projecting portions between the radial grooves 3 and the back hole 6.

In the conventional tip 10 for a ball-point pen, however, air caught in the tip 10 by rotation of the ball 11 during writing is not easily discharged, and a large amount of air is sometimes undesirably held in the tip 10. When the ball-point pen is left in this state with its tip 10 being directed upward, the level of the ink in the ink guide hole 2 and the radial grooves 3 is lowered to the back hole 6. Then, the ink becomes faded at the start of writing. In the worst case, the level of the ink in a tube fitted with the rear end of the tip 10 is lowered to the rear end of the tube, making this ball-point pen unusable (to be referred to as a back flow hereinafter). Furthermore, during high-speed writing, the flow of the ink is interfered with by the air caught in the tip 10, so that the ink is not supplied to the ball 11, thus disabling writing, or the ink is very slowly supplied to the ball 11.

SUMMARY OF THE INVENTION

In order to solve the above problems, the present inventors have made intensive studies, and have found that when the diameter and length in the axial direction of the ink guide hole are set within predetermined ranges of ratios with reference to the ball diameter, no major inconvenience is caused in the quality of the ball-point pen. The present inventors have also found that when the diameter of a cleaning tool, used for removing the flash which is formed during machining of the radial grooves by cutting (broaching) and which projects into the ink guide hole, is defined, and a base portion of the flash is partly left, the performance of the ball-point pen is further improved.

More specifically, the metal tip for a ball-point pen according to the present invention is characterized by having an ink guide hole formed at the center of the bottom surface of a ball holding portion and radial grooves arranged around the ink guide hole, wherein the ink guide hole has a 30 to 55% diameter of a ball and a length in the axial direction 1.2 to 2 times the diameter of the ink guide hole.

When the diameter and length in the axial direction of the ink guide hole are defined in this manner, a large improvement in quality can be obtained. Furthermore, when the cleaning tool, used for removing the flash which is formed during machining of the radial grooves by cutting and which projects into the ink guide hole, is set to have a 70 to 97% diameter of the ink guide hole, and only the base portion of the flash is partly left, a rather large improvement in quality can be obtained.

It is also preferable to form the radial grooves to have opening portions that open to the vicinity of the ball in the ink guide hole.

When the diameter of the ink guide hole is smaller than a 30% diameter of the ball, the ink is not supplied sufficiently, so that supply of the ink cannot catch up with high-speed writing. In addition, the diameter of the tool used for forming the ink guide hole is decreased. Then, the tool tends to be broken easily, leading to a poor productivity. Inversely, when the diameter of the ink guide hole exceeds a 55% diameter of the ball, the portion where air can be collected is enlarged, and thus the air in the tip cannot be easily discharged. Then, when the ball-point pen is left with its tip being directed upward, a back flow tends to be caused easily, and the faded length of the ink at the start of a subsequent writing operation is increased.

When the length of the ink guide hole in the axial direction is smaller than 1.2 times the diameter thereof, the air caught in the tip easily flows into the back hole 6, so that the back flow can be caused easily. If the length of the ink guide hole in the axial direction is larger than 2 times the diameter thereof, the ink is not supplied sufficiently, and ink exhaustion tends to be caused easily during writing.

If the flash formed during machining the radial grooves is not removed at all, a very thin portion formed at the distal end portion of the flash sometimes drops during writing, thus interfering with the writing operation.

When the diameter of the cleaning tool is a 70% diameter of the ink guide hole or less, the tool does not touch the flash, so that the obtained result becomes the same as in a case wherein the flash is not removed. When the diameter of the cleaning tool is a 97% diameter of the ink guide hole or more, the obtained result becomes the same as in a case wherein the flash is removed completely, and an improvement in quality cannot be observed.

According to the present invention, the length of the ink guide hole in the axial direction is set to 1.2 to 2 times the diameter thereof. Since the length of the ink guide hole is large, when the radial grooves are formed to open to the back hole directly, the obtained result is the same as in a case wherein the diameter of the ink guide hole is increased.

Then, the effect obtained by setting the diameter of the ink guide hole to a 55% diameter of the ball or less is canceled undesirably. As the portion where the air can be collected is enlarged, the air in the tip is hard to be discharged, the back flow tends to be caused easily, and the faded length of the ink at the start of the writing operation is increased. Therefore, it is preferable that the opening portions of the radial grooves be formed to open to the vicinity of the ball.

As the metal that can be used in the holder of the metal tip for the ball-point pen of the present invention, any of the conventionally known metals can be used. The practical examples of the metal are a copper alloy such as nickel silver, phosphor bronze, or brass, an aluminum alloy, a titanium alloy, various types of stainless steels, and the like.

Similarly, as the material of the ball, any of the conventionally known materials can be used. The practical example of the material includes a carbide alloy, a metal such as stainless steel, a ceramic such as zirconium oxide or silicon carbide, and the like.

DESCRIPTION OF THE PREFERRED EMBODIMENT

The present invention will be described in further detail by way of a preferred embodiment thereof. Note that the present invention is not limited by this embodiment.

Figure 1:
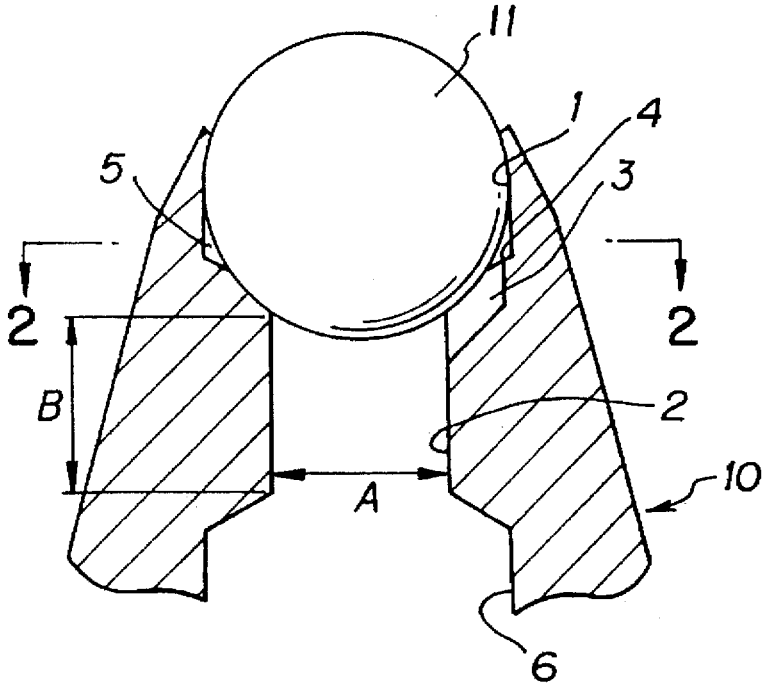
FIG. 1 is a sectional front view (a sectional view taken along the line 1—1 of FIG. 2) showing a conventional metal tip for a ball-point pen.
Figure 2:
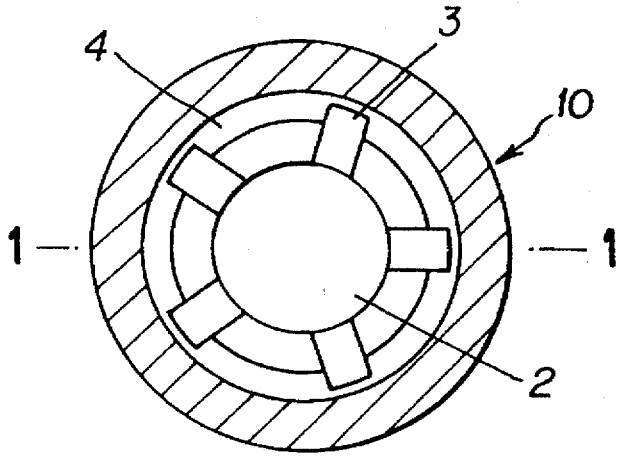
FIG. 2 is a sectional plan view taken along the line 2—2 of FIG. 1.
Figure 3:
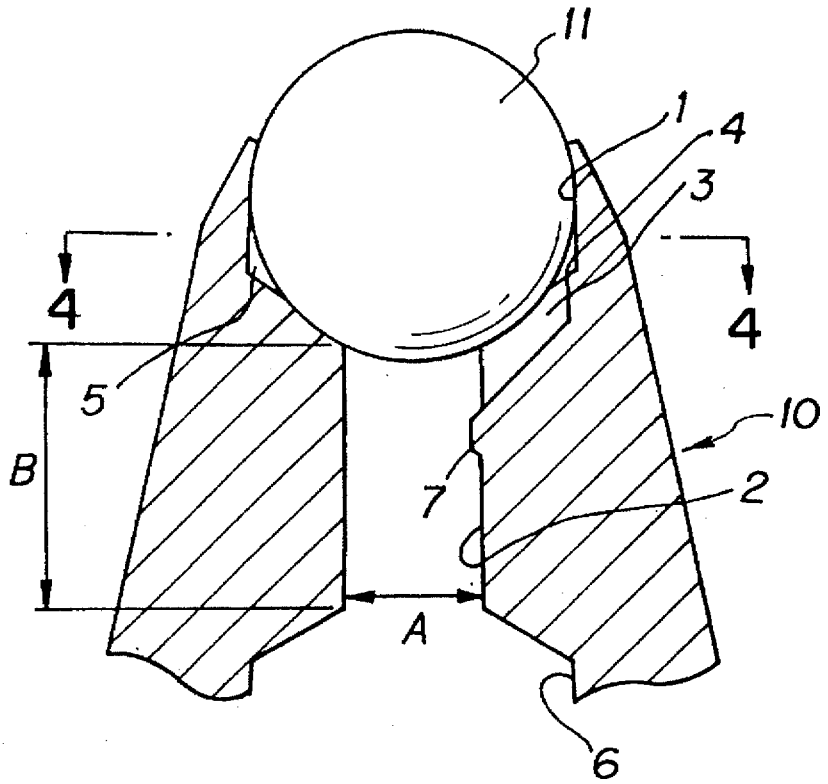
FIG. 3 is a sectional front view (a sectional view taken along the line 3—3 of FIG. 4) showing a metal tip for a ball-point pen according to the present invention.
Figure 4:
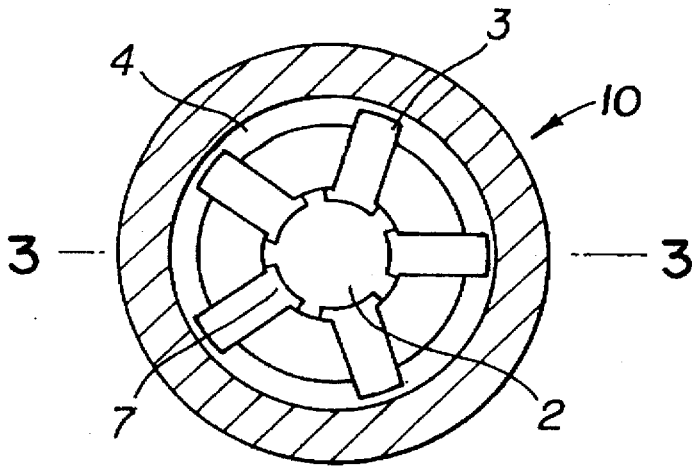
FIG. 4 is a sectional plan view taken along the line 4—4 of FIG. 3.

FIGS. 3 and 4 show an embodiment of the present invention. With reference to FIGS. 3 and 4,. in which parts similar to those previously described with reference to FIGS. 1 and 2 are denoted by the same reference to FIGS. 1 and 2.

The metal tip 10 for a ball-point pen, as shown in FIGS. 3 and 4, consists of an ink guide hole 2 formed at a center of a bottom surface 4 of a ball holding portion 1 and radial grooves 3 are arranged around the ink guide hole 2, and a back hole 6 formed behind the ink guide hole 2.

The back hole 6 reserves an ink to guide ink to the ink guide hole 2. The ink guide hole 2 guides the ink near the ball 11 and radial grooves 3 for guiding the ink to an ink reservoir 5 that stores the ink actually used for writing.

In FIGS. 3 and 4, the diameter of the ball 11 is 0.70 mm, the diameter A of an ink guide hole 2 is 0.30 mm (about 43% of the diameter of the ball 11), and the length B of the ink guide hole 2 in the axial direction is 0.58 mm (about 1.9 times the diameter of the ink guide hole 2). As a cleaning tool used in the step of removing a flash, a drill having a diameter of 0.25 mm (about 83% of the diameter A of the ink guide hole 2) is used. As a comparative example, FIGS. 1 and 2 show a tip 10 whose ball 11 has a diameter of 0.70 mm, which is the same as that in the present invention, and whose ink guide hole 2 has a diameter A of 0.40 mm (about 57% of the diameter of the ball 11) and a length B of 0.40 mm (equal to the diameter A of the ink guide hole 2). In this tip 10, a drill having a diameter of 0.40 mm (equal to the diameter A of the ink guide hole 2) is used as the cleaning tool.

The shape and number of radial grooves 3, and furthermore the outer shape of the tip 10, the sizes and shapes of other portions, and the like are arbitrarily defined, and the present invention is not limited by the accompanying drawings.

Table 1 shows results obtained by examining various tips, formed by changing their dimensional relationship and the diameter of the cleaning tool employed, concerning the following test items. Tips satisfying the requirement for the dimensional relationship of the present invention are serially numbered as examples, and tips not satisfying it are serially numbered as comparative examples. The materials of the holder and ball of all of the tips fabricated this time are stainless steel and a carbide alloy, respectively.

As the cleaning tool, a drill was employed.

The test items of the examples and comparative examples are as follows.

(a) Result of back flow test (the number of tips in which the back flow occurred in n=100)

Method

A spiral line with a diameter of about 20 mm is drawn for 20 circles with each sample by hand without using any instrument, and thereafter the sample is set upright with its tip being directed upward.

In this state, the sample is placed in a reduced-pressure chamber. The pressure is reduced to 1.5 mmHg, and the sample is left still in the chamber for 5 minutes.

The interior of the chamber is restored to the atmospheric pressure. Samples in which the ink leaks from the rear ends of the refills, i.e., samples in which the back flow has occurred, are counted.

When the amount of air collected in the tip is large, the back flow occurs easily.

(b) Average value of faded length (mm) of the ink at the start of writing in n=10

Method

A spiral line with a diameter of about 20 mm is drawn for 20 circles with each sample by hand without using any instrument, and thereafter the sample is set upright with its tip directed being upward for 1 hour.

Thereafter, a spiral line is drawn in the same manner by hand without using any instrument. The length of the faded length of the ink at the start of writing is measured with a spline.

(c) Catch-up ability in high-speed writing test

Method

The catch-up ability in a writing operation at a writing speed of 16 cm/sec is evaluated in five levels with a writing tester.

⊙: writing is perfectly satisfactory

○: writing is marginally satisfactory

Δ: writing is sometimes impossible

▲: writing is rarely possible x: writing is impossible at all (d) Recoverability upon occurrence of ink exhaustion in high-speed evaluation test Method Writing is performed at a writing speed of 66 cm/sec with a writing tester. Writing is continued even after ink exhaustion. Recoverability until re-writing is enabled is evaluated in five levels.

⊙: writing is recovered within 50 mm

○: writing is recovered within 100 mm

Δ: writing is recovered within 200 mm

▲: writing is recovered within 400 mm x: writing is not recovered within 400 mm

TABLE 1

| Samples | Diameter of ball (mm) | Diameter (mm) of ink guide hole (% with respect to diameter of ball) | Length (mm) of ink guide hole (magnification with respect to diameter of hole) | Diameter (mm) of cleaning tool (% with respect to diameter of guide hole) |
|---|---|---|---|---|
| Example 1 | 0.70 | 0.30 (43) | 0.58 (1.9) | 0.29 (97) |
| Example 2 | 0.70 | 0.33 (43) | 0.60 (1.8) | 0.28 (85) |
| Example 3 | 0.70 | 0.35 (50) | 0.65 (1.8) | 0.30 (86) |
| Example 4 | 0.70 | 0.38 (54) | 0.50 (1.3) | 0.35 (92) |
| Example 5 | 1.00 | 0.40 (40) | 0.65 (1.6) | 0.38 (95) |
| Example 6 | 1.00 | 0.50 (50) | 0.75 (1.5) | 0.35 (70) |
| Comparative Example 1 | 0.70 | 0.40 (57) | 0.40 (1.0) | 0.40 (100) |
| Comparative Example 2 | 0.70 | 0.20 (29) | 0.40 (2.0) | 0.20 (100) |
| Comparative Example 3 | 1.00 | 0.60 (60) | 0.60 (1.0) | 0.60 (100) |
| Comparative Example 4 | 1.00 | 0.28 (28) | 0.60 (2.1) | 0.28 (100) |

| Samples | Result of back flow test (count) | Faded length of the ink (mm) at start of writing | Catch-up ability in high-speed writing | Recoverability after ink is exhausted in high-speed writing |
|---|---|---|---|---|
| Example 1 | 0 | 1.0 | ⊙ | ⊙ |
| Example 2 | 0 | 0.3 | ⊙ | ⊙ |
| Example 3 | 0 | 0.5 | ⊙ | ○ |
| Example 4 | 0 | 0.4 | ⊙ | ○ |
| Example 5 | 0 | 2.5* | ○ | Δ |
| Example 6 | 0 | 1.0 | ○ | ○ |
| Comparative Example 1 | 2 | 2.0 | Δ | Δ |
| Comparative Example 2 | 10 | 3.0 | ○ | Δ |
| Comparative Example 3 | 4 | 5.0 | ▲ | ▲ |
| Comparative Example 4 | 10 | 4.0 | Δ | x |

*Whereas the diameter of the ball is 1.0 mm in Example 5, it is 0.7 mm in Comparative Example 1. Although it looks as if the faded length of Example 5 were worse than that of Comparative Example 1, if the diameter of the ball is set to 0.7 mm in Example 5, the faded length will be 2.0 mm or less.

From the results of the above test, the following facts become apparent.

When the metal tip 10 for a ball-point pen according to the present invention is employed, air caught in the tip 10 during writing is easily discharged, and a large amount of air is not collected. Hence, even if the ball-point pen is left upright with its tip 10 being directed upward, the ink drop is suppressed, the back flow is not easily caused, and a faded length of the ink at the start of re-writing after the ball-point pen is left upright is decreased. As the volume occupied by air in the tip 10 is decreased, supply of the ink is not easily interfered with. Hence, the catch-up ability of the ink during high-speed writing is improved. Even if ink exhaustion occurs, since the air is discharged within a short period of time, the ball-point pen is recovered quickly.

Furthermore, the diameter of the cleaning tool, used for removing the flash which is formed during machining of radial grooves 3 by cutting and which projects into an ink guide hole 2, is set to a 70 to 97% diameter of the ink guide hole 2, and the base portion 7 of the flash is partly left. Thus, the behavior of air in the tip 10, in particular near the ink guide hole 2, is limited. As a result, the ink drop is further suppressed when the ball-point pen is stored upright, and the faded length of the ink at the start of writing is decreased.

What is claimed is:

1. A tip for a hall-point pen with a ball having a diameter set therein, said tip comprising:

a ball holding portion within which the ball is positioned;

an ink guide hole, said ink guide hole having a diameter and being formed at a center of a bottom surface of said ball holding portion, a portion of the ball extending into said ink guide hole;

radial grooves arranged around said ink guide hole, each said groove angularly oriented with respect to said ink guide hole;

a flash oriented into said ink guide hole and projecting along 1.5% to 15% of said diameter of said ink guide hole; and a back hole formed behind said ink guide hole;

wherein said ink guide hole diameter is 30% to 55% of the diameter of the ball and said guide hole has an axial length of 1.2 to 2 times said ink guide hole diameter.

2. A tip for a ball-point pen as in claim 1, wherein said flash is formed in said ink guide hole during machining of said radial grooves a portion of said flash being removed with a cleaning tool having a diameter 70 to 97% of the diameter of said ink guide hole, so that only a base portion of said projecting flash is left extending into said ink guide hole 1.5% to 15% along the lateral radial extent of said guide hole.

3. A tip for a ball-point pen as in claim 1, wherein said radial grooves open to a vicinity of said ink guide hole in which the ball is positioned and do not extend to said back hole.

4. A tip for a ball-point pen as in claim 2, wherein said radial grooves open to a vicinity of said ink guide hole in which the ball is positioned and do not extend to said back hole.

* * * * *